United States Patent [19]

Gonsalves et al.

[11] 3,999,730

[45] Dec. 28, 1976

[54] TROLLEY CONVEYOR TRACK SWITCH UNIT

[76] Inventors: George E. Gonsalves, 480 Lamont Ave.; Felice Dosso, 485 Genessee Ave., both of Staten Island, N.Y. 10312

[22] Filed: Oct. 23, 1975

[21] Appl. No.: 624,853

[52] U.S. Cl. ..... 246/434; 403/220

[51] Int. Cl.[2] ..... E01B 7/06

[58] Field of Search ..... 246/434, 314, 415 R; 104/103, 130; 64/2 R, 15 C; 403/220, 291, 51

[56] References Cited

UNITED STATES PATENTS

| | | | |
|---|---|---|---|
| 3,193,675 | 7/1965 | Parkes | 246/434 |
| 3,605,628 | 9/1971 | McElroy | 246/314 |

*Primary Examiner*—Trygve M. Blix
*Assistant Examiner*—Reinhard J. Eisenzopf
*Attorney, Agent, or Firm*—Watson Leavenworth Kelton & Taggart

[57] ABSTRACT

A switch rail for a trolley conveyor track system is disclosed, the switch rail comprising an inherently flexible rail segment joined to a straight rail segment, the switch rail being movable from first to second switching positions for connecting a first track section selectively with second and third track sections, the flexible rail segment embodying a rigid link for limiting flexure movement thereof to movements codirectional to that in which the axis of the straight rail segment moves when the switch rail is shifted between its first and second switching positions.

9 Claims, 7 Drawing Figures

TROLLEY CONVEYOR TRACK SWITCH UNIT

BACKGROUND OF THE INVENTION

Trolley conveyor track systems are widely used in department stores, warehouses, factories and a wide range of other business and industrial activities for the purpose of transporting stock, parts and broad classes of goods between central collecting and distributing stations and remote stations. Systems of this type employ a main track which can have a number of sections and various branch track sections which make juncture with the main track at a switching station. The switching station usually includes a switch rail unit which is adapted in one switching position for connecting together two sections of the main track while in a second switching position, the switch rail unit connects a main rail track section with a branch track. With respect to monorail-type conveyor track systems, it has been commonplace heretofore to provide the switch rail as a flexible rail member such as either a coil spring or length of resilient material or as a rail member of two rigid components connected to each other at a universal joint. In such fashion, the switch rail is designed to assume a bent, arcuate or curved position when it is moved to a position for connecting the main track to a branch track. In respect of such switch rails as are provided in the form of rigid members joined by universal joint connection, the same offers the drawback that too often, a trolley traversing the turn thereon between the main track and a branch track, is derailed since it cannot negotiate properly the single point turn structure at the juncture of the rigid members. Flexible rail sections, as heretofore used in the art, e.g., as exemplified in U.S. Pat. No. 3,605,628, while sufficiently flexible to provide a smooth curving and in effect plural point track switch course, have the disadvantage that the flexible member deflects under the weight of the trolley and load with such flexure offering resistance to continued travel, i.e., such condition can undesirably slow or even stop the trolley.

Accordingly, it is desirable that an improved switch rail unit be provided for such trolley conveyor track systems which unit not only provides a smooth curving track course but regardless of the switching position thereof will not be subjected to undesirable flexure, particularly such flexure as tends to depress the switch rail below the horizontal plane of alignment of the respective track sections.

SUMMARY OF THE PRESENT INVENTION

The present invention relates to improvements in trolley conveyor track systems generally and is particularly applicable to a switch rail unit for employment in a monorail trolley conveyor track system. While the invention will be described in terms of its adaptation to a monorail trolley system, it will be appreciated that it is not limited solely to such systems. For example, the principles to be described herein could readily be adapted to a two-track system.

In accordance with the present invention, a switch rail unit is provided for connecting a first main track section selectively with either a second main track section or a third track section such as a branch line angularly converging with the second main track section. In normal operation of the switch rail, in a first position thereof, the switch rail will extend in a generally straight course to connect two sections of main rail track. When shifted from its first to second switching positions, the switch rail assumes a generally arcuate configuration so as to connect one of the main track sections with a branch track section disposed in angular converging course with said main track section. The means for supporting the various main track and branch track sections from overhead are conventional and well known in the prior art.

In accordance with the present invention, the switch rail unit includes a first elongated straight rail segment and a second elongated and inherently flexible rail segment, one end of which is connected to one end of a first main track section with the other end of the said flexible rail segment being connected with one end of the straight rail segment. Means are provided for supportingly shifting the straight rail segment from a first switching position wherein the other end thereof is aligned with a second main track section to a second switching position wherein the said other end of the straight rail segment is aligned with a branch track section. When the straight rail segment is in its first switching position, the flexible rail segment is disposed in longitudinal axial alignment with the straight rail segment and when the straight rail is in its second position, the flexible rail segment is flexed into an arcuate course, the second rail segment having inherent flexibility to be flexed angularly relatively of the axis of the straight rail segment. The flexible rail segment includes a plurality of relatively rigid plates extending in closely spaced array between the said one end of the straight rail segment and the first main track section with the respective plates each being provided with central slots. A rigid link member on which the plates are carried loosely extends through said slots with the fit being such that with respect to the link member, the plate members can be slid only laterally relatively thereto. Such lateral sliding movement of the plate is possible only in the direction in which the flexible rail segment flexes when the straight rail segment is moved from its first to second switching positions, and thus in turn is limited by the employment of the link plate arrangement to movements codirectional to that in which the axis of said straight rail segment moves when it is shifted between its first and second positions. Since both the link and plate members are rigid elements, there can occur no flexure of the flexible rail segment, for example, downwardly so as to present a problem of impeding smooth trolley travel along the track rail during operation of the conveyor system, there thus being means embodied in the flexible rail segment for limiting flexure thereof except in a desired and prescribed direction.

Means in the form of one or more elongated ligaments which pass through each of the respective plate members are provided for the purpose of maintaining the respective plate members in axial alignment with each other and with said straight rail segment when the last mentioned rail segment is in its first position. When the straight rail segment is moved to its second position, the ligaments which have flexibility sufficient to that purpose flex into an arcuate disposition to maintain the respective plate members disposed in an arcuate course.

For the purposes of mounting the switch rail unit and where the respective track sections are tubular members, elongated rigid mounting members can be provided and be receivable in the first track section and in the said one end of the straight rail segment, with the link in the flexible rail segment being pivotably connected to said mounting members.

To facilitate the flexing of the inherently flexible rail segment, the relatively rigid plate members have portions at at least one side of the flexible rail segment of relatively lesser thickness than remaining portions. That is the thickness at the lateral extreme of the plates is thinner than that of the central portion thereof. Such reduced thickness can, for example, be provided as a laterally or outwardly diminishing tapering sector in the plates so that the plates when axially aligned have a slight face-to-face spacing at the marginal extremities of each. However, when the flexible rail segment is caused to flex, the peripheral length or longitudinal marginal expanse of the flexible rail segment along said one side shortens with the plates pivoting on the link member and coming together into contact with each other at the lateral marginal extremes thereof to facilitate such shortening of the side peripheral dimension of the flexible rail segment, with there being a corresponding elongation of the peripheral length of the flexible track rail at a diametrically opposite side, the spacing between the respective plates at the opposite side being insufficient to impede in any way the smooth transit of a trolley roller thereover.

The invention accordingly comprises the features of construction, combination of elements and arrangement of the parts which will be exemplified in the construction hereinafter set forth and the scope of the invention will be indicated in the claims.

BRIEF DESCRIPTION OF THE DRAWINGS

A fuller understanding of the nature and objects of the invention will be had from the following description taken in conjunction with the acompanying drawings, in which.

Throughout the following description like reference numerals are used to denote like parts in the drawings.

DESCRIPTION OF THE PREFERRED EMBODIMENTS

Figure 1:
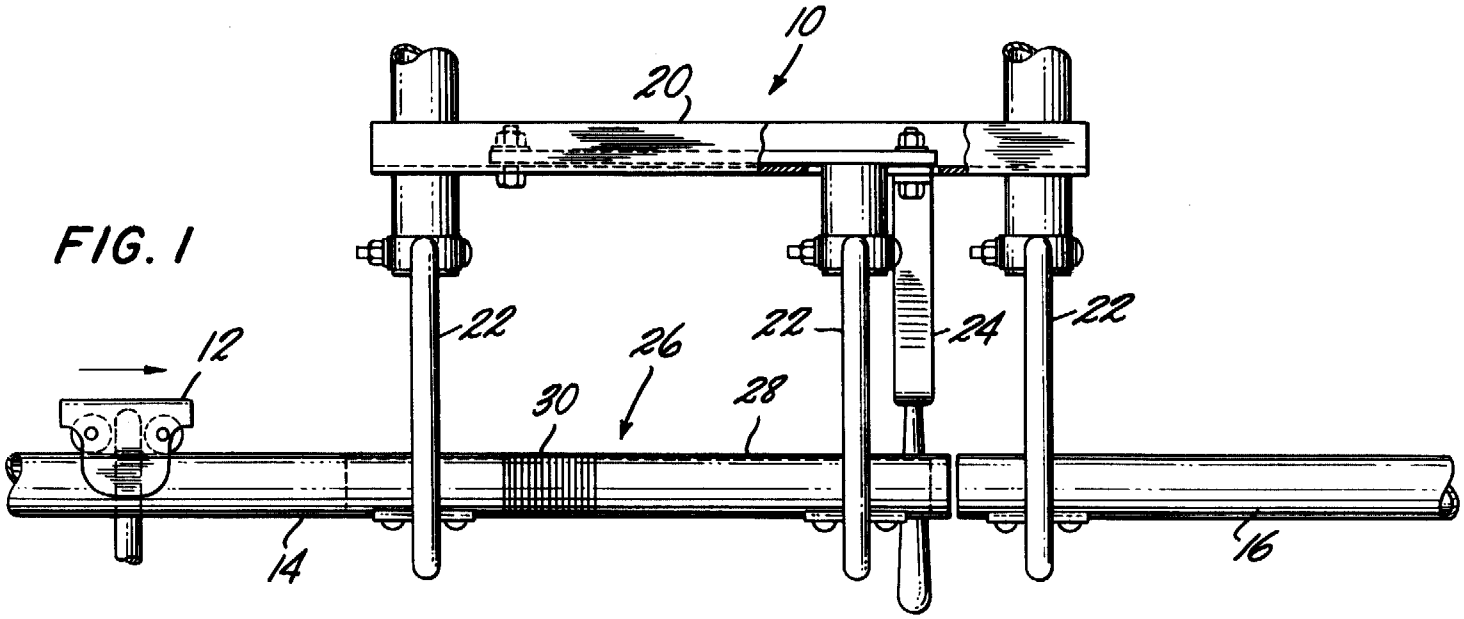
FIG. 1 is a side elevational view of a trolley conveyor track system switching station embodying a switch rail unit constructed in accordance with the principles of the present invention, the switch rail unit being shown in the first operative position of the straight rail segment thereof, wherein the switch rail unit connects two main track sections.
Figure 2:
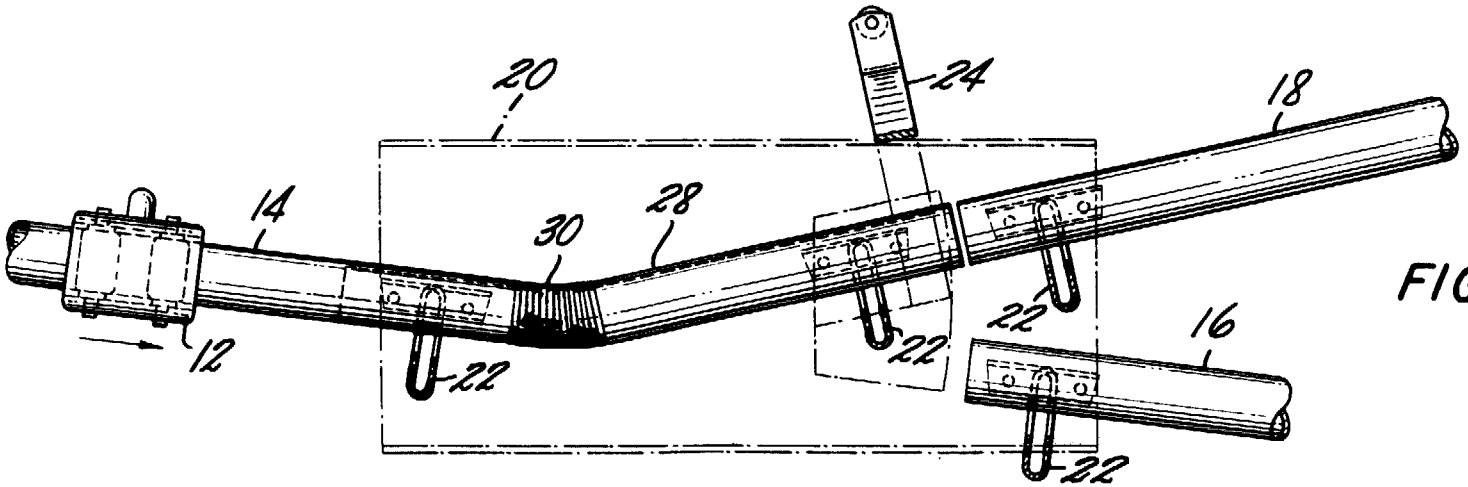
FIG. 2 is a top plan view of the switching station shown in FIG. 1, the switch rail unit being shown in a second operative position wherein it connects one main track section with a branch track section.

Referring now to FIGS. 1 and 2 of the drawings, there is depicted generally at 10, a switching station for a trolley conveyor track system. In the depicted embodiment, the trolley conveyor track system is a monorail system using single rail tracks for passage of a load-carrying trolley 12 thereon. Moreover in the system depicted, the tracks are shown as being hollow cylindrical tubular components. It should be understood that other shapes of track, both solid and hollow and of square or rectangular profile, could be employed so that the principles of the present invention should not be taken to be limited solely to the disclosed embodiments. For example, a switch rail unit having two switching rails for a two-track system could easily be provided following the teaching of the present invention.

Referring now in greater detail to FIGS. 1 and 2 there is depicted a main track which includes a first main track section 14 and a second main track section 16, the latter and, as is conventional at at least terminus lengths thereof, being arranged in longitudinal alignment with track section 14. Adjacent track section 16 is a third track or branch track section 18 which converges angularly with track section 16. Conventional overhead supporting structure 20 from which suspension brackets 22 depend also is provided, the latter brackets 22 functioning in the usual manner for supporting the various track sections, there also being shown switch throwing or positioning member 24 which functions in conventional manner to move the below described switch rail straight rail segment between its two operative positions. Only such supporting structure as is required for a complete understanding of the present invention and as is necessary for description of the functioning of the switching station is depicted.

In accordance with the present invention, the switch rail unit shown generally at 26 includes an elongated generally straight rail segment 28 and an elongated inherently flexible rail segment 30 which is sufficiently flexibly structured to be flexed angularly relatively of the axis of segment 28. As will be noted, the inherently flexible rail segment 30 is connected at one end thereof with the first main track section 14, with the other end of the flexible rail segment being connected with one end of the straight rail segment 28. As indicated above, member 24 is provided for supportingly shifting the straight rail segment 28 from the first switching position depicted in FIG. 1 wherein the other end of said straight rail segment is aligned with the second track section 16 to a second switching position wherein the said other end thereof is aligned with the third track section 18. Thus when the straight rail segment 28 is in its first position, the flexible rail segment is disposed in longitudinal alignment with the straight rail segment (and track section 16) and when the straight segment is moved to its second position the flexible rail segment 30 is flexed or bent into a generally arcuate course as best seen in FIG. 2. Thus depending upon the positioning of the straight rail segment, traffic from main track section 14 can be conveyed along the switch rail to the other main track section 16 or to the branch track section 18.

Figures 3, 4, 5, 6, 7:
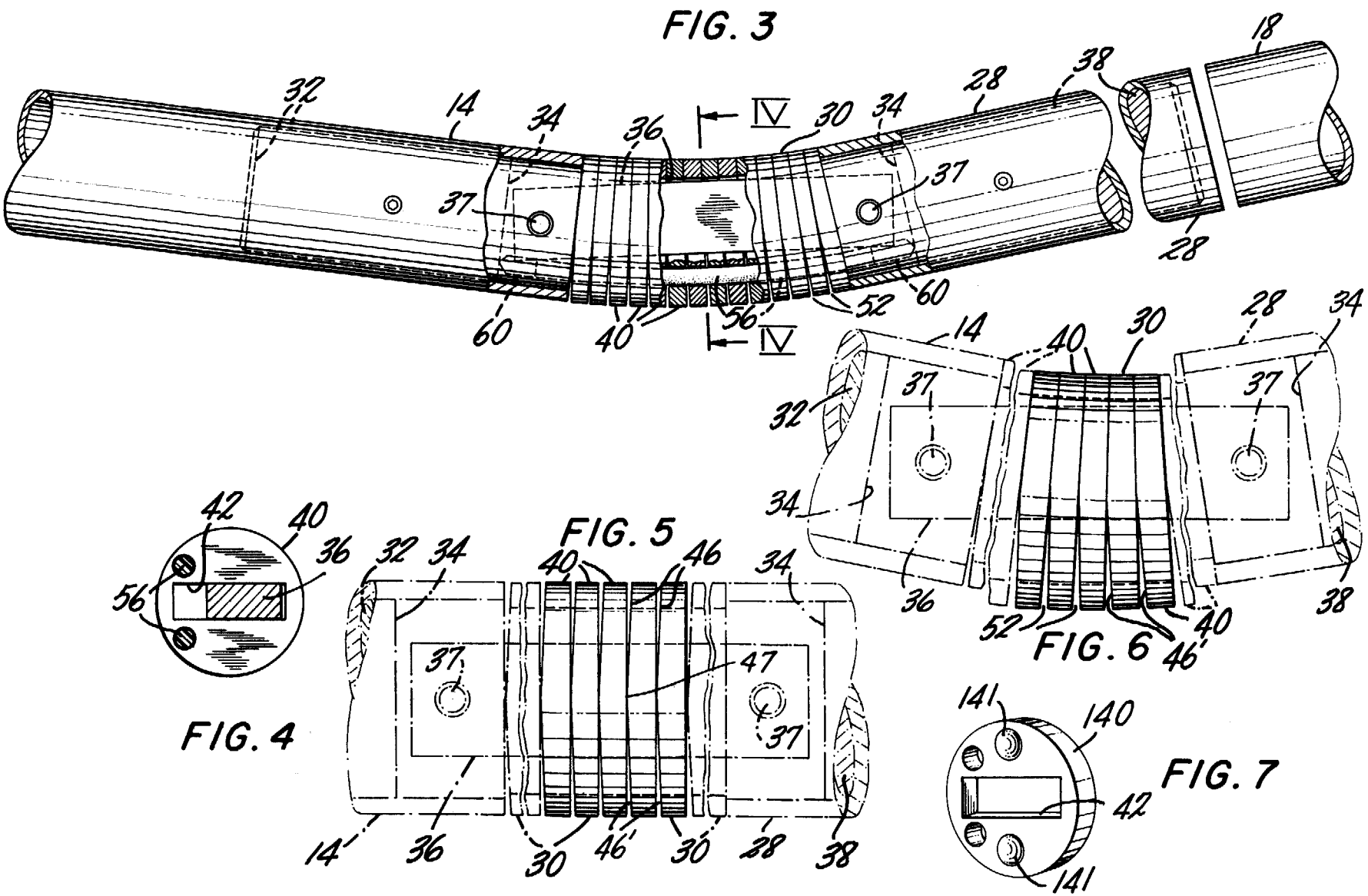
FIG. 3 is a top plan view partly in section and on enlarged scale depicting the switch rail unit shown in FIGS. 1 and 2 in its second switching position wherein it connects one main track section with the branch track.
FIG. 4 is a sectional view as taken along the lines IV—IV in FIG. 3.
FIG. 5 is a fragmentary plan view on still further enlarged scale of a portion of the flexible rail segment showing the manner in which the plate members align when the straight rail segment is in its first position, portions of the straight rail segment and first track section being shown in phantom view.
FIG. 6 is the same as FIG. 5 except it shows the manner in which the plates come together at one side of the flexible rail segment to shorten the peripheral dimension thereof at said one side when the latter is disposed in its arcuate course.
FIG. 7 is a perspective view depicting a further embodiment of flexible rail segment plate and an alternate manner whereby the side portions thereof can be made relatively thinner than central portions of the plate.

With further reference now to FIGS. 3–6, the switch rail unit as indicated includes the flexible rail segment 30 and the straight rail segment 28 connected together in the manner best noted in FIG. 3. For the purposes of mounting the flexible rail segment 30 to main track section 14 and in the instance where the latter is a hollow tubular element, a rigid mounting member 32 is provided, such mounting member being received in track section 14 and having one end thereof slotted as at 34 for defining opposed mounting surfaces to which one end of elongated rigid link member 36 is connected as by a pivot 37, the said one end of mounting member 32 being, e.g., of bifurcated character. The other end of the link member 36 is pivoted in like fashion to a mounting member 38 received in the said one end of said straight rail segment 28. Received loosely on the elongated link 36 and extending in closely spaced and face-to-face array between the first track section 14 and the said one end of the straight rail segment 28 is a plurality of relatively rigid plates 40, the rigid plates 40 being provided with centrally disposed slots 42 through which the link 36 is received. The link 36 as can be seen in FIG. 5 is axially aligned with the axis of straight rail segment 28 when the latter is in first switching position. As shown in FIGS. 4 and 7, the slots 42 in each of the respective plates 40 are elongated in a direction laterally of the link to permit lateral sliding relative movement between each plate 40 and the link 36 to allow flexure of rail segment 30, the plate members otherwise closely embracing said link members to limit the relative movement therebetween to said lateral relative movement. In other words, the top and bottom margins of the slot closely fit against the upper and lower surfaces of the link so the plates cannot tend to rotate about the axis of the link. The lateral relative movement which may be effected with the flexible rail segment is limited by the link member 36 and slot 42 arrangement in the plates to a flexure movement which is codirectional to that in which the axis of the straight rail segment 28 moves when it is shifted from its first to second positions. Thus, for example, and with reference to to FIG. 1 which shows a horizontal track arrangement, there can be no downward or vertical flexure of the flexible rail segment as is possible with flexible switching rail structure of the prior art. Moreover, the arcuate course the flexible rail segment assumes when the straight rail segment is shifted to its second position and as depicted in FIG. 3 provides a smoothly curving travel course for the trolley 12 to pass from the main rail section 14 to the branch track section 18. It also will be noted that when referring to lateral sliding movement of the plate members 40 relative to link 36, "lateral" means a direction of movement which is also codirectional to that in which the axis of said straight rail segment moves when said straight track segment is shifted between its two positions.

For the purposes of permitting the flexible rail segment to flex into an arcuate course and in which arcuate configuration, the marginal expanse of the flexible rail section at one side must be reduced or shortened, each of the respective plate members 40 has portions of relatively lesser thickness at the lateral extremes thereof at said one side as at 46 than said plates have at central portions thereof as at 47. The relative degrees of thickness in the plates can be formed in various ways as by milling or like operation so that when the straight rail segment is moved to its second positon, the plate members 40 at the said one side (upper side of the switch rail unit in FIG. 3) can pivot on link 36 into contact one against the other at said one side to thereby shorten the marginal expanse of the said one side of the flexible segment, with there being concurrently a lengthening of the marginal expanse at a diametrically opposite side of said flexible rail segment as represented by the separation of the plates as at 52 in FIGS. 3 and 6. However, such separation is not to such a degree as to interfere with the smooth rolling of the trolley over the flexible rail section.

The flexible rail segment also includes elongated flexible ligaments 56 extending lengthwise of the flexible track section and through each of the plates 40, with the ligaments 56 acting to axially align each of the plate members 40 one with the others and with the straight track segment 28 when said straight track segment is in its first position and in which switching position, the plates are maintained by the ligaments disposed parallel to each other and transversely of link 36. The ligaments 56 are sufficiently flexible to assume an arcuate disposition as shown in FIG. 3 when the straight rail segment is moved to its second position and to dispose the plates 40 in a corresponding arcuate course. The opposite ends of the ligament as will be noted are received loosely in bore passage 60 formed in each of the mounting members 32 and 38, the passages 60 being disposed respectively parallel to the axis of track section 14, and parallel to the axis of straight rail segment 28.

The present invention also provides that the plates 40 can be provided with reduced thickness portions at both sides of the flexible rail segment as shown at 46′ in FIGS. 5 and 6 so that the switch rail could if desired be moved to still another third position in which it would align with still another branch track section (not shown in the drawings but which in FIG. 2 would be spaced below and angularly related to branch section 18). In such circumstances, flexure of the flexible rail segment while being possible in arcuate courses in each of two opposite directions would still occur only in movements codirectional to that in which the axis of the straight rail segment moves when shifted.

FIG. 7 depicts an alternate form of plate 140 which can be used in flexible rail segment 30 in contrast with the plates 40 described earlier, and in which the same are provided with relatively lesser thickness at the marginal extremities than at central portions thereof. The plate 140 can be made of substantially uniform thickness except in a central part thereof where at both the top and bottom of the plate, suitable projections 141 can be provided, as for example, in the form of a semi-spheroid, such projections functioning to give the plate 140 greater thickness in the central portion than at the sides. Thus the plates 140 when mounted on link 36 can be pivoted on the link to bring the side marginal portions thereof into contact for reducing the longitudinal expanse of the flexible rail segment in the same manner as earlier described for in respect of plate 40.

The number of plates employed in the flexible rail segment will depend of course on the angle of the turn the switch rail is intended to provide. In the depicted embodiment, the angle between branch track 18 and main track section 14 is about 18° to 20° and a 14 point (14 plates) flexible rail segment is used, the system track diamter being substantially 1 5/16 inches.

As those skilled in the art will readily perceive, modifications can be made within the scope of the present invention. For example, the link member 36 while disclosed as being a single rigid component could be made as a two element component, the respective two elements being pivoted to the straight track section 14 and the straight rail segment 28 and further being pivoted together (articulated) at mid-length of the link member. With respect to the materials which desirably can be employed for the switch rail unit, it will be appreciated that the relatively rigid components can be made from a wide range of materials including metals such as steel, aluminum, etc., or they could be made from other materials suited to withstanding the loading to which the trolley conveyor system is intended to be subjected. The ligaments 56 desirably can be provided from any suitable flexible material which possesses the requisite flexibility properties such as nylon, or steel. The important consideration in respect of the ligaments is that the same be capable of flexing from elongated straight course configuration to the arcuate course configuration required for flexing of the flexible rail segment.

It will thus be seen that the objects set forth above among those made apparent from the foregoing description are efficiently attained and, since certain changes in the construction set forth which embody the invention may be made without departing from his scope, it is intended that all matter in the above description shall be interpreted as illustrative and not in a limiting sense.

What is claimed is:

1. In a trolley conveyor track system, a switch rail unit adapted for connecting a first track section selectively with second and third angularly converging track sections, said switch rail unit comprising an elongated straight first rail segment, an elongated second rail segment, one end of said second rail segment being connected with said first track section, the other end of said second rail segment being connected with one end of said straight rail segment, said second rail segment having inherent flexibility whereby the same can be flexed angularly relatively of the axis of said first rail segment, means for supportingly shifting said straight first rail segment from a first switching position wherein the other end thereof is aligned with said second track section to a second switching position wherein the said other end thereof is aligned with said third track section, means in said second rail segment for maintaining same disposed in longitudinal axial alignment with said straight first rail segment when said straight first rail segment is in its first switching position and for maintaining said second rail segment flexed in an arcuate course when said straight first rail segment is in its second switching position, and, means embodied as a rigid member in said second rail segment for limiting flexure movement thereof to movements codirectional to that in which the axis of said straight first rail segment moves when said straight first rail segment is shifted from its first to second switching positions.

2. In a trolley conveyor track system, a switch rail unit adapted for connecting a first track section selectively with second and third angularly converging track sections, said switch rail unit comprising an elongated straight first rail segment, an elongated second rail segment, one end of said second rail segment being connected with said first track section, the other end of said second rail segment being connected with one end of said straight rail segment, said second rail segment having inherent flexibility whereby the same can be flexed angularly relatively of the axis of said first rail segment, means for supportingly shifting said straight first rail segment from a first switching position wherein the other end thereof is aligned with said second track section to a second switching position wherein the said other end thereof is aligned with said second track section to a second switching position wherein the said other end thereof is aligned with said third track section, means in said second rail segment for maintaining same disposed in longitudinal axial alignment with said straight first rail segment when said straight first rail segment is in its first switching position and for maintaining said second rail segment flexed in an arcuate course when said straight first rail segment is in its second switching position, and, means embodied as a rigid member in said second rail segment for limiting flexure movement thereof to movements codirectional to that in which the axis of said straight first rail segment moves when said straight first rail segment is shifted from its first to second switching position, said flexure limiting means comprising a rigid link extending between and pivotably connected to said first track section and said one end of said straight first rail segment, said second rail segment including a plurality of relatively rigid plates carried loosely on said link and disposed in closely spaced and face-to-face array between said first track section and the said one end of said straight first rail segment, said link member aligning with the axis of said first straight rail segment and said alignment means maintaining said plates disposed parallel with each other and transversely of said link means when said straight rail segment is in its first switching position, said plates having slots therein through which said link is received, said slots being elongated to allow for sliding movement of said plates laterally relatively of said link, the plate members otherwise closely embracing said link, portions of said plates at at least one side of said flexible second rail segment having relatively lesser thickness than remaining portions of said plates whereby said plate members can be caused to pivot on said link member and into contact with each other at said one side thereby to shorten the longitudinal marginal expanse of said one side of said second rail segment and concurrently elongate that at the diametrically opposite side for producing flexure of said second rail segment into an arcuate course when said first straight rail segment is moved to its second switching position.

3. A switch rail unit in accordance with claim 2 in which said alignment means comprises at least one elongated flexible ligament extending lengthwise of said second rail segment and through each of said plates, said ligament axially aligning each of said plate members one with the others and with said straight first rail segment when said straight first rail segment is in its first switching position, said ligament being sufficiently flexible to assume an arcuate disposition when said straight first rail segment is moved to its second switching position.

4. A switch rail unit in accordance with claim 3 in which the opposite end portions of said ligament are received in said first track section and in said one end of said straight first rail segment.

5. A switch rail unit in accordance with claim 4 further comprising means for maintaining the respective opposite end portions of said ligament disposed parallel with the axes of said first track section and said straight first rail segment.

6. A switch rail unit in accordance with claim 3 in which said first track section and said straight first rail segment are tubular members, the unit further comprising a rigid mounting member received in said first track section and another rigid mounting member received in the said one end of said straight first rail segment, said link being pivotally connected at its opposite ends to the respective ones of said mounting members.

7. A switch rail unit in accordance with claim 6 in which the opposite end portions of said ligament are received in bore passages in said rigid mounting members, the bore passage in the first-mentioned rigid mounting member extending parallel with the axis of said first track section and that in said other mounting member parallel with the axis of said straight first rail segment.

8. A switch rail unit in accordance with claim 2 in which said first track section and said straight first rail segment are tubular members of substantially circular sectional profile, said plate members being of similar configuration, said slots being of rectangular cross-section, said link means being of correspondingly configured cross-section.

9. A switch rail unit in accordance with claim 2 in which portions of said plates at the said diametrically opposite side of said second rail segment have relatively lesser thickness than said remaining portions of said plates whereby said second rail segment can be flexed into an arcuate course in each of two opposite directions.

* * * * *